US008558461B2

(12) United States Patent
Poehlmann-Martins et al.

(10) Patent No.: US 8,558,461 B2
(45) Date of Patent: Oct. 15, 2013

(54) METHOD AND APPARATUS FOR INDUCTIVE AMPLIFICATION OF ION BEAM ENERGY

(75) Inventors: Flavio Poehlmann-Martins, Mountian View, CA (US); Mark A. Cappelli, Sunnyvale, CA (US); Gregory Rieker, Palo Alto, CA (US)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 491 days.

(21) Appl. No.: 12/804,269

(22) Filed: Jul. 16, 2010

(65) Prior Publication Data

US 2011/0011729 A1 Jan. 20, 2011

Related U.S. Application Data

(60) Provisional application No. 61/271,271, filed on Jul. 20, 2009, provisional application No. 61/271,298, filed on Jul. 20, 2009.

(51) Int. Cl.
*H05B 31/26* (2006.01)

(52) U.S. Cl.
USPC ..... 315/111.51; 315/111.61

(58) Field of Classification Search
USPC ..... 315/111.21, 111.31, 111.41, 111.51, 315/111.61, 111.71, 111.81, 111.91
See application file for complete search history.

(56) References Cited

U.S. PATENT DOCUMENTS

| | | | | |
|---|---|---|---|---|
| 2,961,559 | A | 11/1960 | Marshall | |
| 4,396,867 | A | 8/1983 | Turchi et al. | |
| 4,422,013 | A * | 12/1983 | Turchi et al. | 315/111.81 |
| 6,155,199 | A * | 12/2000 | Chen et al. | 118/723 I |
| 6,523,338 | B1 * | 2/2003 | Kornfeld et al. | 60/202 |
| 6,798,141 | B2 | 9/2004 | Kornfeld et al. | |
| 7,476,883 | B2 | 1/2009 | Nutt | |
| 2005/0069076 | A1 * | 3/2005 | Bricault et al. | 376/190 |
| 2007/0139976 | A1 * | 6/2007 | deRochemont | 363/17 |

OTHER PUBLICATIONS

Cheng, "Plasma deflagration and the properties of a coaxial plasma deflagration gun", 1970, pp. 305-317, Nuclear Fusion v13.
Marshall, "Performance of a hydrodynamic plasma gun", 1960, pp. 134-135, The Physics of Fluids v3n1.
Mather, "Investigation of the high-energy acceleration mode in the coaxial gun", 1964, pp. S28-S34, The Physics of Fluids Supplement.
Woodall, "Observation of current sheath transition from snowplow to deflagration", 1985, pp. 961-964, Journal of Applied Physics v57n3.

* cited by examiner

*Primary Examiner* — Minh D A
(74) *Attorney, Agent, or Firm* — Lumen Patent Firm

(57) ABSTRACT

Accelerated charged particles are provided by inductive amplification of particle energy in connection with a deflagration-mode plasma discharge. The deflagration mode discharge tends to increase particle energy relative to other operating modes. Inductive amplification of particle energy further increases output particle velocity. Inductive amplification can occur by formation of a current loop in the plasma discharge, and/or by a sudden increase in inductance due to collapse of the current distribution of the plasma discharge. Applications include particle therapy and production of radio-isotopes.

17 Claims, 7 Drawing Sheets

METHOD AND APPARATUS FOR INDUCTIVE AMPLIFICATION OF ION BEAM ENERGY

CROSS REFERENCE TO RELATED APPLICATIONS

This application claims the benefit of U.S. provisional patent application 61/271,271, filed on Jul. 20, 2009, entitled "Method and Apparatus for Inductive Amplification of Ion Beam Energy", and hereby incorporated by reference in its entirety. This application also claims the benefit of U.S. provisional patent application 61/271,298, filed on Jul. 20, 2009, entitled "Plasma Accelerator and High Energy Plasma Applications", and hereby incorporated by reference in its entirety.

FIELD OF THE INVENTION

This invention relates to the use of a plasma discharge to provide accelerated charged particles.

BACKGROUND

Plasma discharges have been employed to provide accelerated charged particles for many years. To date, two main operating modes of such plasma discharges have been identified. In the first mode, sometimes referred to as the snowplow mode, a plasma gun is allowed to fill with gas before high electric voltage is switched to the electrodes. When the voltage is applied, the gas breaks down, typically at the breech of the plasma gun, and forms a narrow current sheet that is pushed downstream by the j×B force.

The second mode is sometimes referred to as the plasma deflagration mode, and can be accessed by reversing the order of gas injection and voltage switching relative to the snowplow mode. In the deflagration mode, breakdown occurs at the gas front, and the discharge region travels upstream to process new gas entering the electrode gap. The deflagration discharge region can be made stationary by establishing a downstream gas flow. In either case, the processed gas is accelerated downstream without being significantly inhibited through collisions with downstream gas. Since the processed gas in the snowplow mode experiences collisions, the deflagration mode has the potential to provide higher output particle velocity than the snowplow mode.

The difference between the snowplow mode and a plasma deflagration is analogous to the difference between an explosive shock front (detonation) and a flame (deflagration) in combustion theory. A detonation deposits its available energy predominantly into heating and compression whereas a deflagration deposits a higher fraction into directed kinetic energy. As a result, a plasma deflagration can produce directed gas speeds that are several times higher than in the snowplow mode (detonation) case. Further information relating to the plasma deflagration mode can be found in an article by Cheng entitled "Plasma deflagration and the properties of a coaxial plasma deflagration gun" (Nuclear Fusion v 10 1970, pp 305-317), and hereby incorporated by reference in its entirety.

Although the plasma deflagration mode can provide higher particle velocity than the snowplow mode, it remains desirable to further increase particle velocity.

SUMMARY

In the present work, inductive coupling of energy is employed to enhance the performance of plasma deflagration particle accelerators. Here, the term plasma deflagration refers to an electromagnetic hydrodynamic accelerating mechanism in which the accelerated particles are accelerated as they move through a current carrying region when viewed in the reference frame of the current carrying region.

The term inductive coupling of energy is used to refer to any mechanism that makes use of the inductance of the system or any part of the system to effect the transfer of energy to particles. Thus far, two specific mechanisms of this type appear to have been identified. In the first mechanism, the inductance after collapse of the current distribution is higher than before. In the second mechanism, a current loop is formed and the inductance of the current loop is smaller than the inductance prior to formation of the current loop. In both cases, the change in inductance leads to enhanced power transfer to the accelerated particles.

FIG. 1 schematically shows an example of accelerator apparatus according to principles of the invention. In this example, a plasma discharge source 102 including electrodes 106 and 110 is capable of operating in a deflagration mode and has a gas flow 108 that defines upstream and downstream directions. More specifically, the downstream direction is in the direction of gas flow 108, and the upstream direction is the opposite direction. The example of FIG. 1 also includes an inductive coupling subsystem 104 that is capable of inductively coupling energy to charged particles of the plasma discharge to provide accelerated charged particles as an output. With respect to subsystem 104, FIGS. 1-3 are to be understood as system block diagrams, and there is therefore no significance in the location of 104 on these figures. As will become clear in the following detailed description, various features of the electrodes and/or plasma discharge circuitry can provide the inductive coupling of energy.

As indicated above, this accelerator operates in the plasma deflagration mode. Accordingly, it is preferred during operation of the accelerator to either energize the electrodes prior to providing input gas for the discharge, or to energize the electrodes no more than 200 μs after providing input gas. It is also preferred for the electrical ringing frequency of the apparatus to be 50 kHz or greater. Another preferred feature is for the electrode length of the plasma discharge source to be within +/±20% of the length of the plasma discharge when inductive coupling of energy to charged particles of the plasma discharge occurs. This last condition can be viewed as the plasma roughly "filling" the accelerator prior to the inductive energy coupling.

In some cases, inductive energy coupling can be enhanced by providing a static or time-varying applied magnetic field, in addition to the self-induced magnetic field of the plasma discharge. FIG. 2 shows an example, where 202 is the applied magnetic field.

In the examples of FIGS. 1 and 2, gas is injected at the upstream end of the accelerator (i.e., near source 102). In some cases, it can be desirable to also inject gas at a downstream location of the accelerator. FIG. 3 shows an example of this approach, where a particle source 302 provides particles at the downstream end of the accelerator. Source 302 can be a gas source, or any other source of particles (e.g., a source that vaporizes or ablates a liquid or solid to provide particles).

Thus far, several design approaches have been found to give good results for particle acceleration. In the first approach, the circuit inductance is made low relative to the electrode inductance. Here the term circuit inductance includes the integrated series inductance of components in the power circuit and transmission lines, but excludes the inductance of the electrodes. FIG. 4 shows a preferred embodiment of this approach, where the circuit inductance is 50 nH or less, and the electrodes for the plasma discharge have inductance per unit length of 450 nH/m or more. In the second approach, the circuit inductance is relatively high. More generally, the second approach can also work if the inductance of the portion of the accelerator that is upstream of the current loop (as described below) is high (e.g., 500 nH or more). FIG. 5*a* shows a preferred embodiment of this approach, where the circuit inductance is 500 nH or more. In the third approach, the inductance per unit length of the electrodes decreases in the downstream direction. This can be accomplished in various ways known to those of skill in the art, e.g., by tapering the electrodes. FIG. 5*b* shows a preferred embodiment of this approach, where the inductance per unit length at point 504 is less than the inductance per unit length at point 502, and point 504 is downstream relative to point 502. Preferably, there exists a downstream location that has an inductance per unit length that is 50% or less of the inductance per unit length at an upstream location. Here inductance per unit length is understood to include the inductance per unit length of the electrodes and exclude the inductance per unit length of the plasma discharge. The above-described first and third approaches can be practiced individually or in any combination. Similarly, the above-described second and third approaches can be practiced individually or in any combination.

Without being bound by theory, the present understanding of the above design approaches is based on two physical mechanisms. The first physical mechanism relates to collapse of a current distribution of the plasma discharge from a first configuration to a second configuration having greater self-inductance than the first configuration. FIGS. 6*a-e* show an example. In this example, a plasma discharge 606 is initiated at the left ends of electrodes 602 and 604 (FIG. 6*a*), and then extends to the right as time goes on (FIGS. 6*b*, 6*c*, and 6*d*). When the current distribution of the plasma discharge collapses, the resulting configuration is as shown in FIG. 6*e* (i.e., the new configuration is localized at a downstream part of the pre-collapse configuration). Current distribution collapse as shown here can be facilitated by matching the length of the electrodes to the length of the plasma discharge, as described above and below. Another approach for facilitating this desirable mode of current distribution collapse is to provide upstream mass starvation of the plasma discharge.

The self-inductance of the configuration of FIG. 6*e* is higher than the self-inductance of the configuration of FIG. 6*d*. This increase in inductance can cause a voltage increase across the electrodes, which can contribute to particle energy. In view of this mechanism, the design rules of the example of FIG. 4 can be understood as maximizing the effect of this inductance change by having the electrode inductance per unit length (which results in different inductance for FIGS. 6*d* and 6*e*) be greater than the circuit inductance (which is the same for the current configurations of FIGS. 6*d* and 6*e*).

The second physical mechanism relates to formation of a current loop having an inductively amplified circulating current in or passing through part of the plasma discharge. FIGS. 7*a-b* show an example of this mechanism. In this example, the accelerator is modeled as an L-C circuit, with a capacitor 702 and inductance provided by electrodes 704 and 706. Because of the inductance per unit length of the system, current that only flows partway down the electrodes (solid lines) sees a smaller inductance than current that flows all the way to the ends of the electrodes (dashed lines). The solid line current has a smaller LC period than the dashed line current, and will therefore reverse direction during oscillation before the dashed line current. FIG. 7*b* shows this state of affairs. A current loop 708 can form. Such a current loop will have a smaller inductance than the inductance of the current distribution prior to current loop formation. By conservation of inductive energy, this decrease in inductance can lead to an increase in the circulating loop current, which can result in higher output particle velocity. The design approaches of FIG. 5*a-b* are believed to facilitate current loop formation and enhance its amplifying effect on particle velocity.

DETAILED DESCRIPTION

Figure 1:
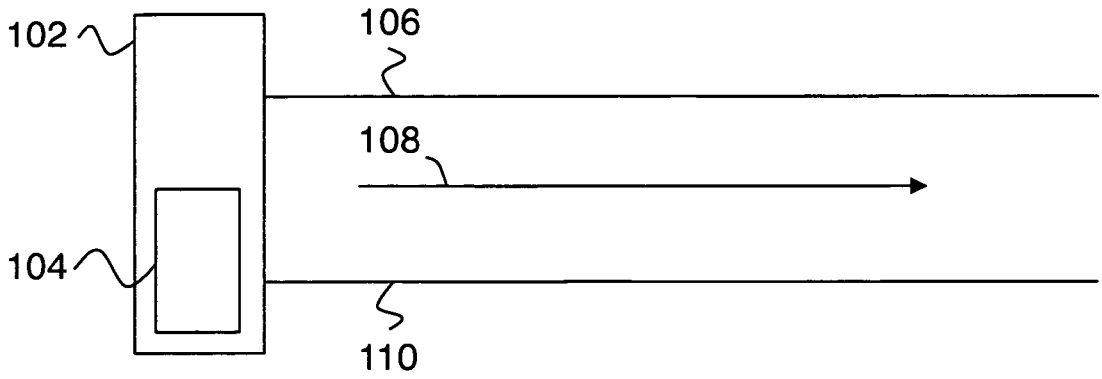
FIG. 1 shows an embodiment of the invention.
Figure 2:
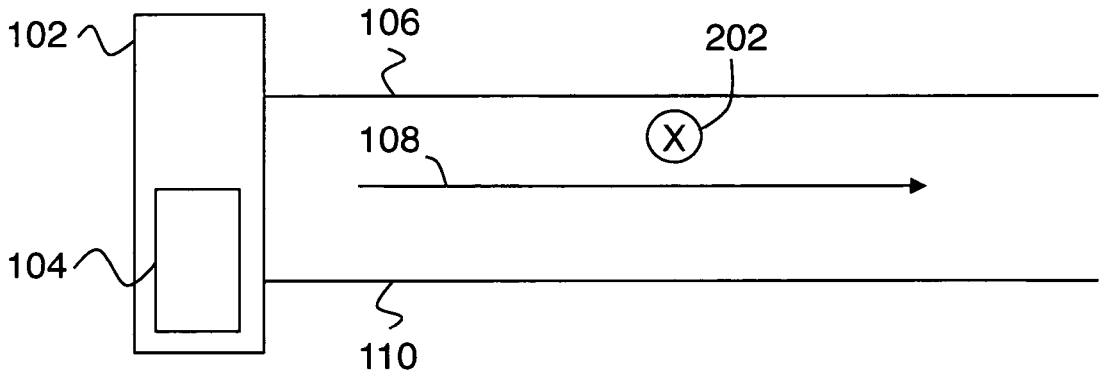
FIG. 2 shows an embodiment of the invention having an additional applied magnetic field.
Figure 3:
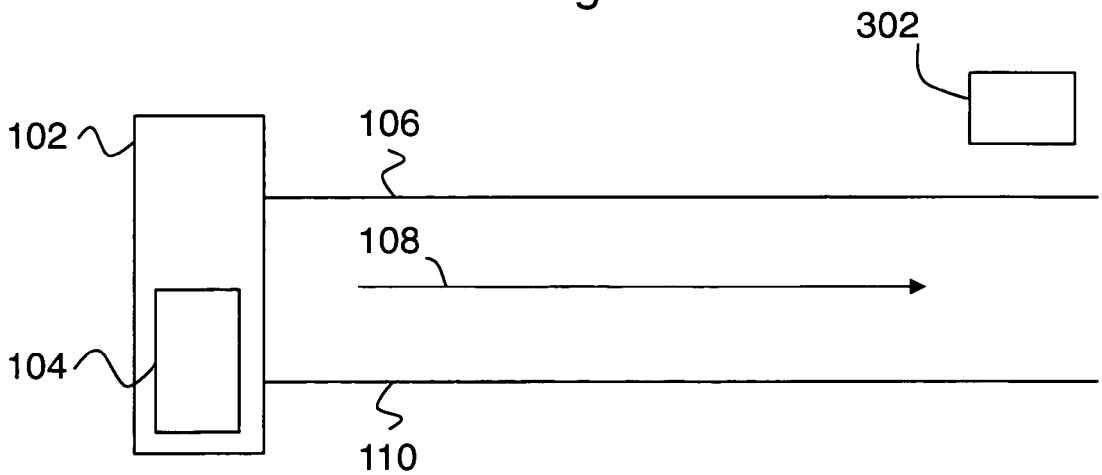
FIG. 3 shows an embodiment of the invention including an additional particle source.
Figure 4:
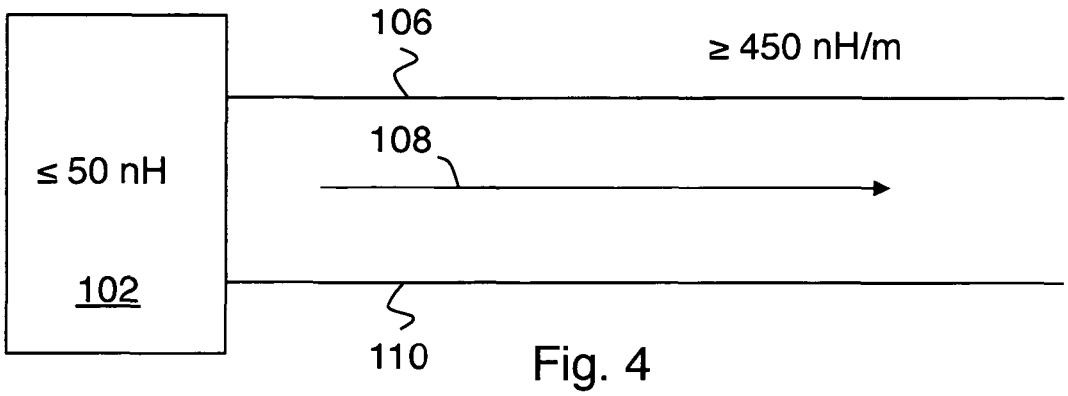
FIG. 4 shows a first preferred design option.
Figure 5A:
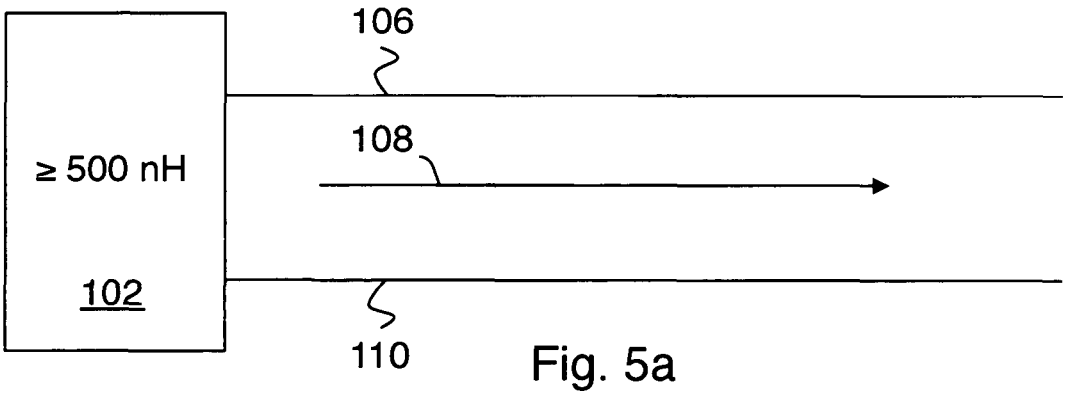
FIGS. 5*a-b* show further preferred design options.
Figure 5B:
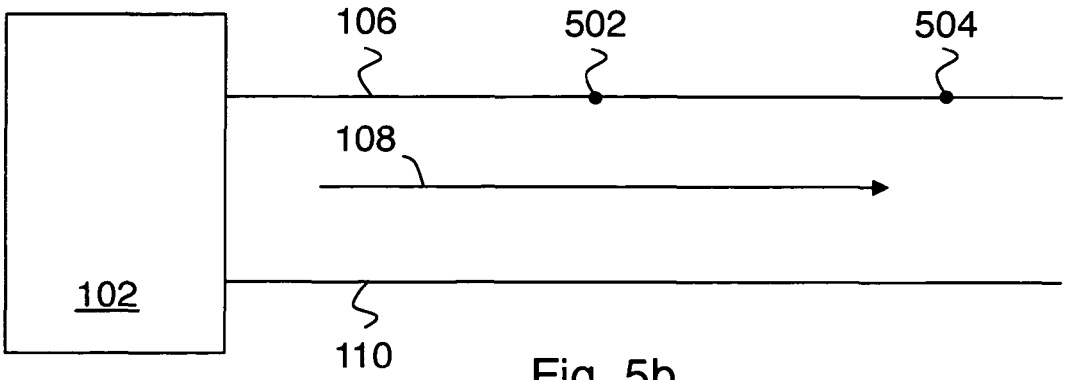

A Inductive Coupling of Energy in Deflagration Mode Plasma

The present approach involves amplifying the kinetic energy of an accelerated plasma by using time-variations in the electrical discharge and/or plasma dynamic effects. A plasma accelerator of this kind can (i) accelerate a plasma more effectively, (ii) achieve higher exhaust speeds and (iii) provide more dense and collimated beams than conventional plasma accelerators.

An exemplary system according to the present principles includes (a) a power supply, (b) a capacitor bank, (c) an electromagnetic plasma accelerator, (d) a gas injection valve and (e) a method of operation that (i) causes the accelerator to operate in a plasma deflagration mode and (ii) inductively amplifies the kinetic energy of the accelerated plasma beam.

A co-axial electrode configuration can be used to pass a current (or current per unit area), J, in the radial direction through a process gas that is injected between the electrodes. This current induces a magnetic field, B, which accelerates the plasma via the Lorentz force acting in the direction perpendicular to both J and B, i.e., in the J×B direction and of magnitude |J×B|, which in this case points axially downstream, in a direction parallel to the center electrode. More specifically, the sequence of events in this example is as follows:

1. The plasma discharge is initiated at the upstream end of the accelerator by discharging a capacitor through the electrodes.
2. The current region expands in the downstream direction as the capacitors continue to discharge.
3. As the voltage and/or current crosses a critical value, the discharge collapses towards the exit plane of the accelerator (see FIGS. 6*a-e*).

This accelerator operates in the plasma deflagration mode. This mode of operation can provide several times higher particle velocities at a given power level than the snowplow mode in which conventional plasma accelerators are operated.

Although different approaches exist to access the deflagration mode, the preferred embodiment accesses it by reversing the order of voltage switching and gas injection compared to conventional plasma accelerators. The voltage is applied to the electrodes before (or shortly after) the gas is injected into the breech of the co-axial tube through an ultrafast valve that can open within a few microseconds. In this case, electrical breakdown occurs at the gas front and the conductive current region travels upstream rather than downstream. The upstream end of the ionization front can become stationary at the injection port and the ionized gas is accelerated electromagnetically while traveling through an extended but stationary acceleration region. Since the acceleration region of a deflagration discharge represents an expansion, the particles can accelerate without compressing slower gas downstream, leading to preferential energy deposition into directed acceleration rather than compression and heating.

Another advantage of this approach is that the overall inductance of the accelerator decreases as the plasma spreads the discharge current downstream. When the current distribution collapses to the downstream end of the electrodes (e.g., as shown on FIG. 6*e*), the rapid increase in inductance causes a voltage increase across the electrodes at some location of the accelerator, which helps the production of fast particles at that location.

Compared to other plasma accelerators, especially conventional coaxial J×B accelerators such as the pulsed plasma thruster (PPT), the present approach differentiates itself by operating in a different mode and by utilizing and optimizing an inductive amplification effect. Advantages include lower required power supply voltages for a given beam energy, higher efficiency as more energy is deposited into directed kinetic energy rather than heating and compression, less electrode erosion due to a diffuse discharge region and a high degree of particle beam collimation.

One advantage of this approach is that it allows for stabilization and optimization of the described mode of operation by choosing the right set of parameters and initiating events within the accelerator in the right order.

For instance, the length of the accelerator and the diameters of both electrodes are preferably chosen to be consistent with the oscillation period of the electric circuit. This means that in one embodiment, the length of the accelerator can be optimized by considering the distance that the plasma discharge can travel inside the accelerator while the capacitors discharge, the capacitance of the capacitor bank, and the inductances in the electric circuitry. The diameter of the outer electrode as well as the ratio of cathode and anode radii should be chosen so that the variation of inductance with axial location achieves a desired level of amplification.

The gas feed system can be used to obtain the deflagration mode. It should be designed in such a way that the discharge will be initiated and remain on the vacuum side of the Paschen minimum (the Paschen minimum is the minimum of breakdown voltage vs. gas pressure for a fixed discharge gap). In the preferred embodiment this is achieved by switching the voltage across the electrodes first, and then injecting the gas at the upstream end of the accelerator using a very fast valve. Alternatively, the mass flow can be set to a low enough value or the initial current rise can be slowed so that shock formation is avoided during the discharge initiation process.

The gas feed system can also be set to a level to ensure that there is a shortage of charge carriers that are provided directly by the gas when compared to the electrons that can be supplied by the support circuitry.

This approach has many advantages relative to conventional accelerators. These include, for example, (i) accelerating plasma more efficiently, (ii) achieving higher exhaust speeds and (iii) providing more dense and collimated beams than conventional plasma accelerators.

A longer accelerator will produce a stronger amplification effect when the discharge collapses towards the exit plane of the accelerator. On the other hand, the length should not exceed the length of the plasma volume (plasmoid) that is formed while the capacitors discharge.

For orthogonal electric and magnetic fields, the drift velocity with which the plasmoid expands is equal to E/B, which must be on the order of $$\frac{E}{B} \propto \frac{l}{\sqrt{(L_T + L_A)C}} \tag{1}$$

if the length, l, of the accelerator is to be filled with gas by the time the current reaches a certain value. In Equation 1, C is the capacitance of the capacitor bank, $L_T$ is the transmission line inductance and $L_A$ is the average accelerator inductance. Realizing that the radial electric field, E, is proportional to the applied voltage, $\Phi_{app}$, divided by the radial distance between the electrodes, D, and that the magnetic field, B, near the cathode is proportional to $L_C I$, where $L_C$ is the inductance of the cathode and I is the current, the proportionality $$l \propto \frac{L_T + L_A}{L_c D} \tag{2}$$

can be derived.

A key element for obtaining the deflagration mode is to operate on the vacuum side of the Paschen minimum and/or under conditions where the discharge is characterized by a shortage of charge carriers. Secondary effects, such as secondary electron emission from the cathode or ion recycling, can provide the missing charge carriers and the entire electrode surface participates in the discharge. Combining this condition with an estimate for the peak current obtained from the initial charge on the capacitors and the expected LC time constant, this translates into the proportionality for the flow of particles per unit time $$\dot{N} \propto \sqrt{\frac{C}{L_T + L_A}}\,\Phi_{app}. \tag{3}$$

An example of a specific accelerator that makes use of these relations has the following properties:

Electrode length: 10 cm to 40 cm

Anode radius: 0.5 cm to 10 cm

Cathode radius: 1 mm to 5 mm

Process gas: 0.01-1 grams/second of hydrogen (during duration of pulse)

Capacitance: 1 microfarads-100 microfarads

Current Loop Formation

Figure 6A:
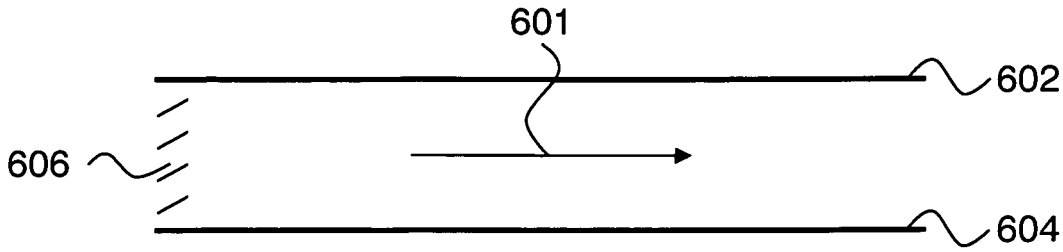
FIG. 6 shows a first inductive energy coupling mechanism.
Figure 6B:
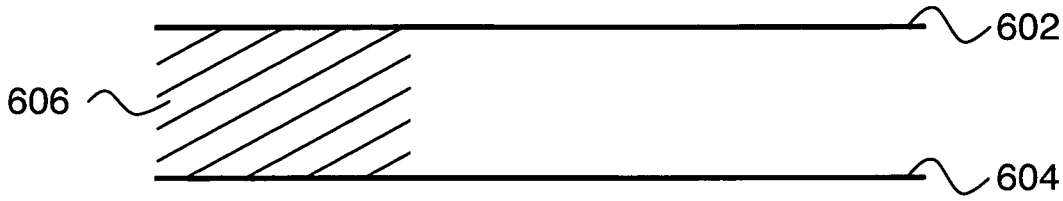
Figure 6C:
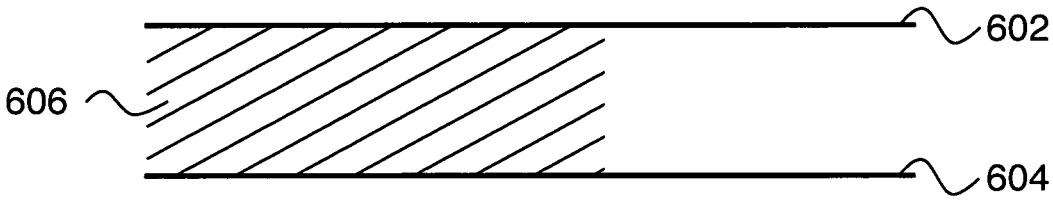
Figure 6D:
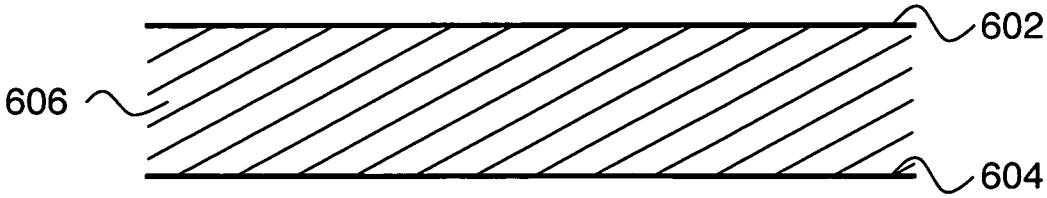
Figure 6E:
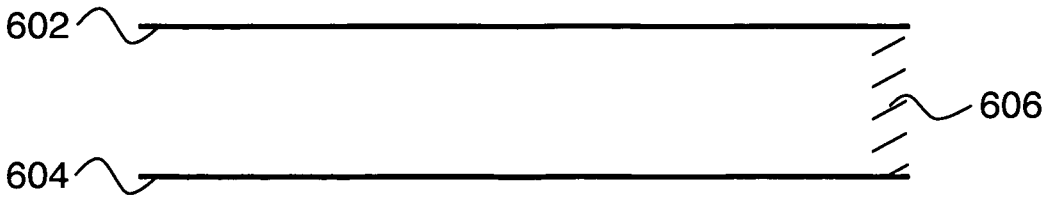

As described above, the plasma deflagration mode can have a diffuse current distribution during part of the discharge (e.g., as shown on FIG. 6*d*). In other words, the radial current that crosses the electrodes is spread along the entire axial distance of the plasma gun, assuming co-axial electrode geometry.

Figure 7A:
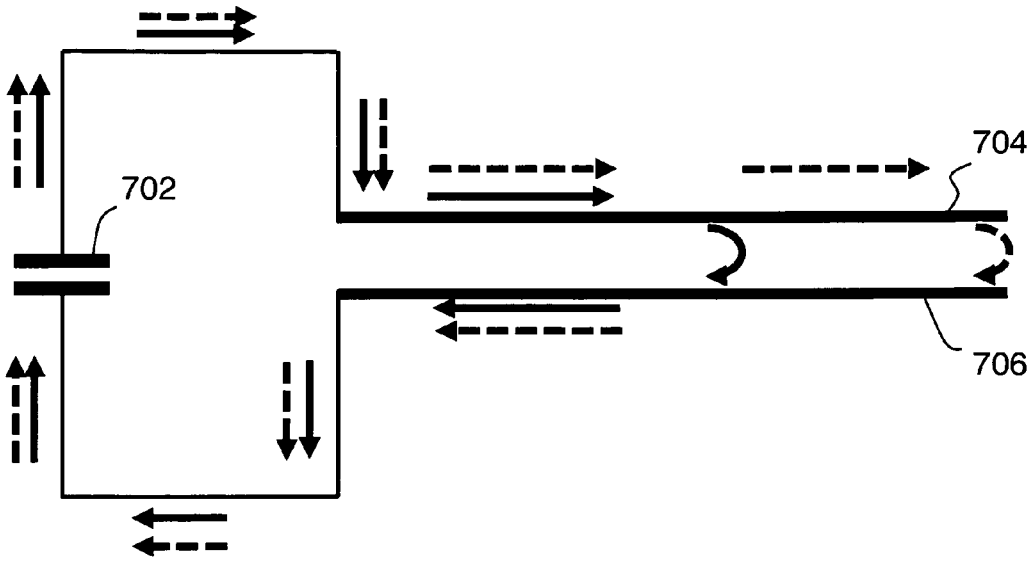
FIGS. 7*a-b* show a second inductive energy coupling mechanism.
Figure 7B:
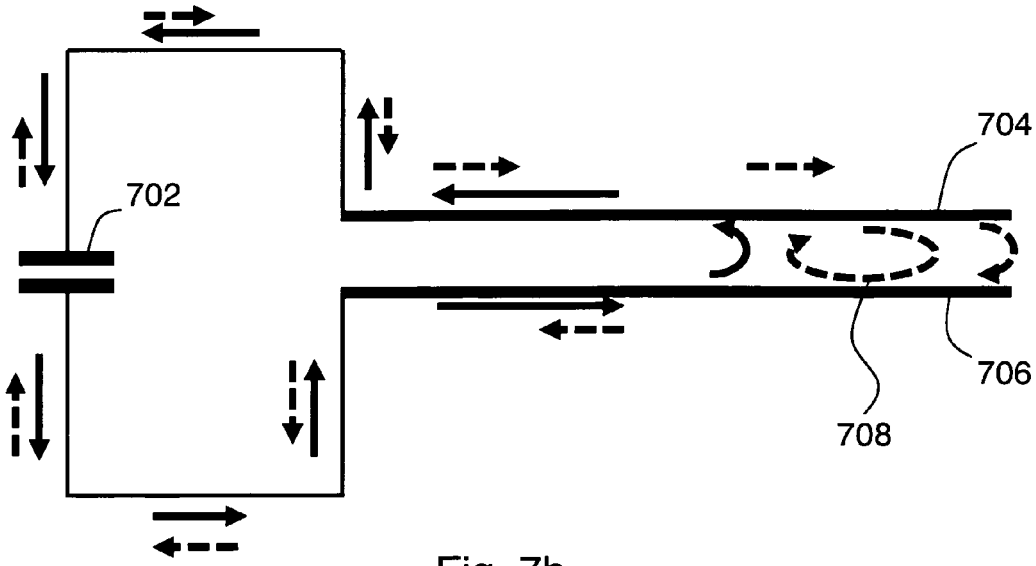

Since the plasma gun has an inductance per unit length associated with it, the portion of current that bridges the electrodes at a more upstream location will see a lower inductance than the current that bridges them at more downstream locations. This is illustrated in FIG. 7*a*. As a result of the different inductances, the LC-time constants, $\tau_1$ (solid lines) and $\tau_2$ (dashed lines), that describe the oscillations of the overall circuit current due to the capacitive energy source and the inductance of the transmission lines and plasma gun, are different as well. Therefore, the reversal of the current will occur sooner at upstream locations than at downstream locations. As shown in FIG. 7*b*, this can lead to a configuration in which a portion of the current is trapped in the formation of a current loop.

Figure 8:
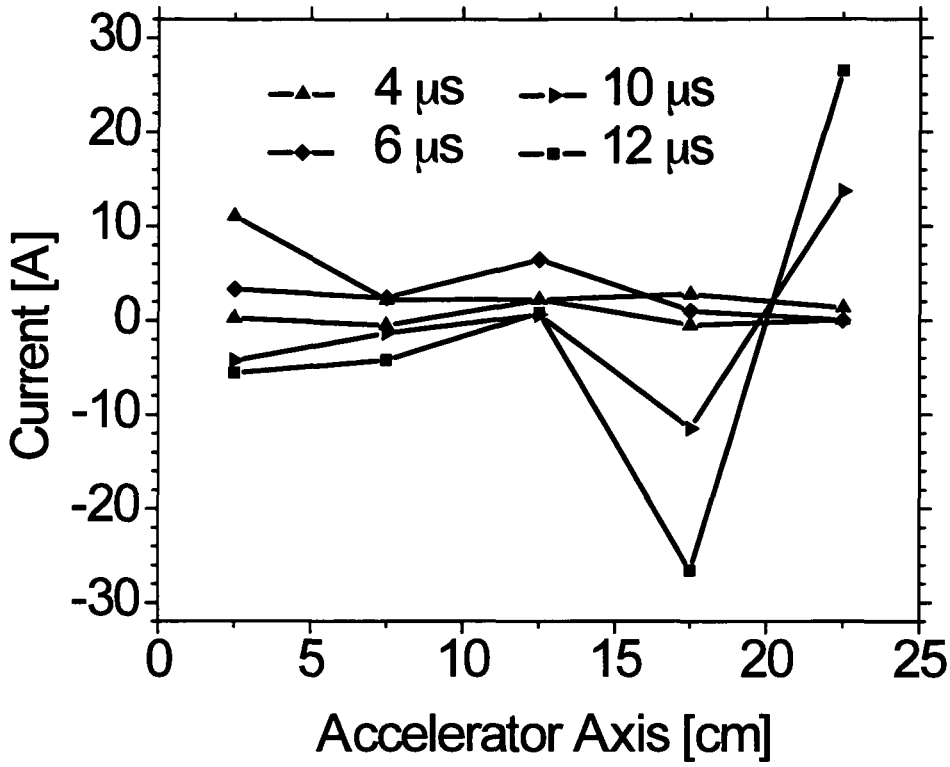
FIG. 8 shows experimental results relating to the mechanism of FIGS. 7*a-b*.

The formation of such a current loop has been experimentally verified by measuring the axial distribution of radial currents. This current distribution is shown in FIG. 8 at different times. It can be seen that for t>6 μs, a current loop forms downstream of the x=15 cm location. This is evidenced by the local minima and maxima at the 17.5 and 22.5 cm locations, respectively. These minima and maxima are also approximately of equal magnitude. In other words, the current that enters the cathode at x=22.5 cm, leaves it again at x=17.5 cm. This is also consistent with fast framing camera images that were taken of the interior of the accelerator.

As can be seen from FIG. 8, the magnitude of the current in the current loop can exceed that of the initial current. This is a result of the conservation of inductive energy $$E = \frac{1}{2}LI^2. \tag{4}$$

When the current loop forms, the inductance, L, that is seen by the current, I, drops rapidly. It then follows that the current has to increase accordingly. As a result of the rapid rise in current, the formation of the current loop can lead to strong accelerating forces on the charged particles in the plasma.

Two ways to enhance the benefits from this amplification effect are to make the ratio of initial to final inductance as large as possible, and to facilitate the drop in inductance to occur as rapidly as possible. The former can be achieved by incorporating a large inductance in the transmission line, tapering the electrodes so that the inductance per unit length decreases in the downstream direction and/or using longer electrodes. The latter can be achieved by designing the circuit to have a small LC-time constant (i.e. a high ringing frequency). The best way to achieve this is by reducing the capacitance as a reduction in inductance would conflict with the first goal. If the capacitance is reduced, the voltage can be increased in order to maintain a constant amount of energy per pulse.

Many alternatives of the above-described examples can also be employed. These alternatives include but are not limited to the following:

Different Mass Feed Techniques

Mass can be introduced to the accelerator with several techniques other than gas injection. For example, a solid material can be ablated, either with the plasma deflagration discharge or with a separately initiated discharge. A liquid could also be vaporized to introduce mass, or a solid could be directly introduced (e.g. as a powder).

Low Operating Pressure Instead of Gas Injection

Reversing the order of voltage switching and gas injection is only one possible mechanism to initiate the discharge on the vacuum side of the Paschen curve. Another possibility is to pre-fill the electrode gap with the process gas at a low enough pressure or to initiate the discharge with a slow enough current rise time so that shock formation is avoided. This condition can also be fulfilled using a snowplow mode pulse through higher pressure gas which leaves behind the proper low density conditions for a deflagration mode pulse. Then the discharge is initiated by applying the potential to the electrodes. Gas breakdown will occur at the location that results in the lowest inductance for the circuit.

Alternative Geometries

Many alternative geometries exist. The electrodes need not be coaxial. For example, a parallel plate configuration is also an option and electrode geometry can also vary axially or azimuthally. In general, any geometry that allows for time-variations in the discharge properties to induce strong fields can be used.

The cathode diameter can be varied, for example it can be reduced to increase the magnetic field strength. The anode diameter can be varied to adjust the pd value, electric field strength at a given voltage and average accelerator inductance, $L_A$.

Applied Fields

In the preceding example the magnetic field is self-induced. Alternative designs can utilize externally applied magnetic fields, for example, magnetic fields created by passing high currents through external metallic or other solid conductors. These magnetic fields can also be time varying (e.g., at a frequency of 50 kHz or more).

Pulse Network

The invention does not depend on any particular electric circuit to work properly. Many different pulse-forming networks can be employed. In addition, active switching can be used to apply the potential to the electrodes or in the pre-filled case the capacitors can be charged until self-breakdown occurs in the accelerator.

Distributed Gas Injection

It is not necessary to inject all the gas at the upstream end of the accelerator. As described above, for a given pressure and inter-electrode spacing, initial gas breakdown occurs at the location that results in the lowest inductance for the circuit. Injecting at least some gas at downstream locations can have advantages, such as faster spreading of the discharge and better stability. Furthermore, additional gas may be injected at a location and time where the particle energy amplification effect occurs in order to increase the number of fast particles.

B Applications

Particle accelerators according to the above-described principles can find numerous new applications, enabled by superior performance relative to conventional particle sources. Descriptions of two such applications follow.

B1 Application to Particle Therapy

Proton radiotherapy is growing in the US and around the world. This growth is due to the commercial availability of proton acceleration facilities and the improved ability of protons over x-rays to deposit a much higher percentage of the radiation dose in the tumor. In the US there are currently five proton therapy centers treating patients and over 2300 x-ray based facilities. Limiting the widespread application of proton radiotherapy to the general cancer patient community is the capital, building and operating costs associated with proton radiotherapy that exceed $100 million per site, a substantial cost differential over x-ray based facilities. A large portion of this cost is the large and complex accelerators that are used to generate the high energy particles (from 5-30 m in diameter), and the beamlines and gantries that transport the particles from the fixed accelerator to the patient.

A compelling approach is to obtain the physical advantages of proton therapy in a smaller, cheaper, gantry-mounted system that can be widely disseminated for improved radiotherapy. One possible embodiment of this approach is based on the above-described compact plasma accelerator, and places the accelerator and beam conditioning hardware in a shielded module that may be gantry-mounted.

Accelerator

The therapeutic range of interest for proton therapy extends from 70 MeV to 250 MeV and a typical required particle delivery rate is on the order of $10^{10}$ protons per second. In order to allow precise control over the delivered dose, the preferred embodiment therefore produces $10^9$ protons per pulse and per MeV. The pulse frequency would then be 10 Hz.

The above-described accelerator design principles yield several valuable insights for maximizing the amplification effect and introduce many design options. First, the amplification can be increased by maximizing the ringing frequency. Second, the inverse dependence of amplification on mass bit size at a given capacitance predicts that higher power to mass flow ratios lead to higher amplification factors. Since the effect of maximizing ringing frequency and minimizing mass bit size is to reduce the size of the accelerator and capacitors, the priority is to achieve the maximum possible amplification through these measures alone. The remaining increase in beam energy to the desired level is then accomplished through an increase in power supply voltage.

Figure 9:
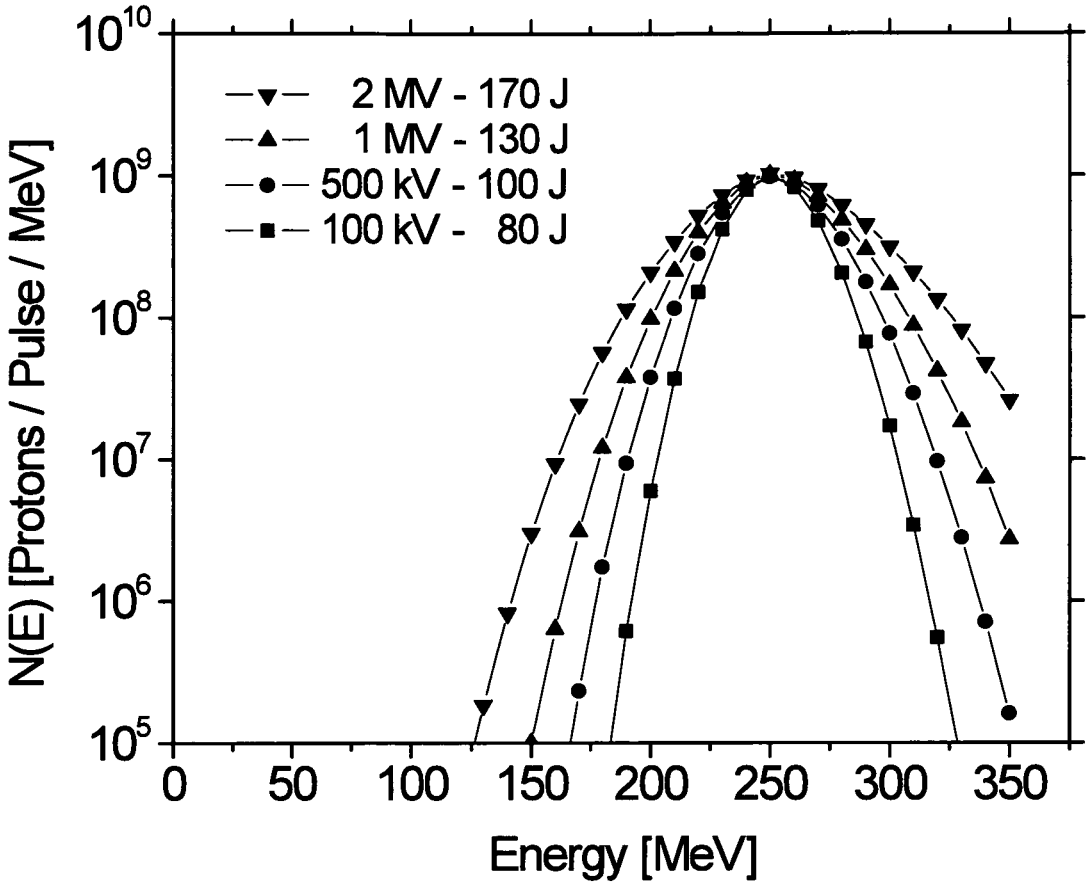
FIG. 9 shows results relating to the particle therapy application.

FIG. 9 shows the effect of varying the applied anode voltage between 100 kV (amplification of 2500×) and 2 MV (amplification factor of 125×) for a proton beam energy distribution that is centered at 250 MeV with $10^9$ protons/MeV/pulse. From FIG. 9, one can see that it is desirable to achieve the maximum possible amplification factor to reduce the spread of the energy distribution.

Figure 10:
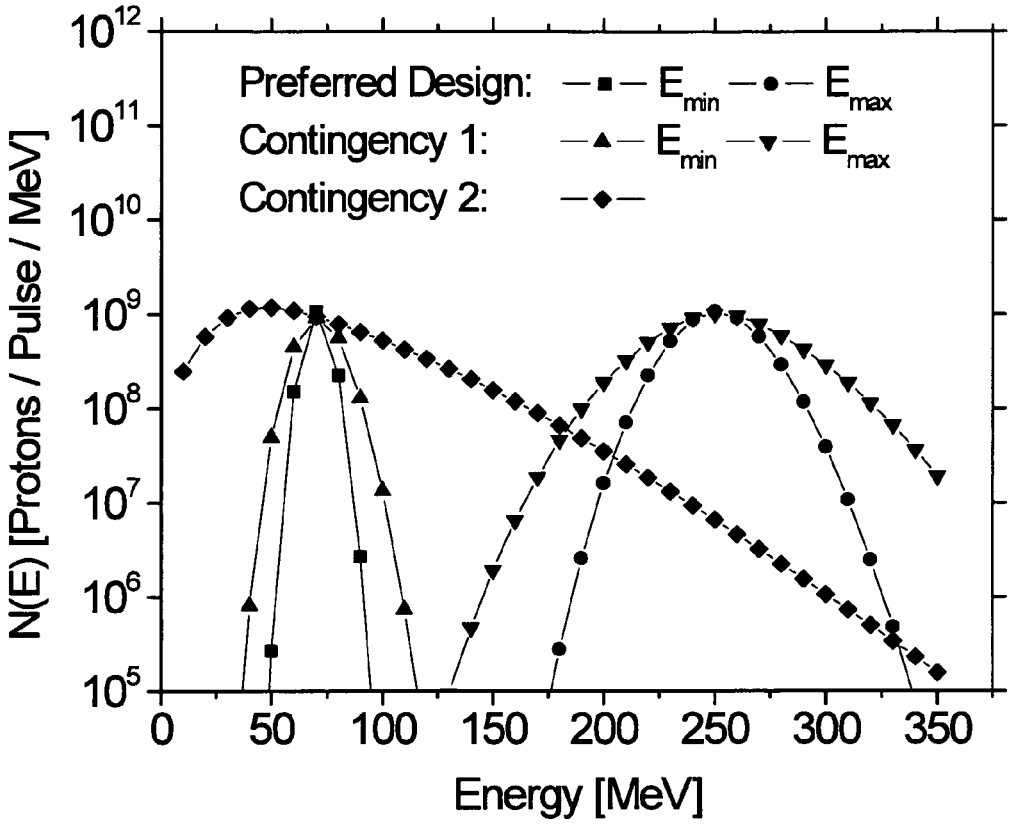
FIG. 10 shows further results relating to the particle therapy application.

Based on these results, several options for potential combinations of operating parameters are possible. FIG. 10 and Table 1 summarize the preferred design and two alternate design choices.

For an amplification factor of 1,000, the proton energy may be tuned between 70 MeV and 250 MeV by varying the applied voltage on the accelerator between 70 kV and 250 kV. As shown in the first two rows in Table 1, this leads to the lowest possible capacitor energy, a low required pulse frequency and the most narrow energy distribution. Note that beam current modulation is achieved by varying the pulse frequency.

TABLE 1

Operating parameters for preferred and two alternative designs.

| Design Option | Applied Voltage | Amplification | Peak of Distibution | Required Frequency | Energy /Pulse | $A_2$ |
|---|---|---|---|---|---|---|
| Preferred Design-low voltage, | 70 kV | 1,000 | 70 MeV | 10 Hz | 27 J | 0.002 |
| high amplification, low $A_2$ | 250 kV | 1,000 | 250 MeV | 10 Hz | 97 J | 0.002 |
| Alternative 1-low amplification | 500 kV | 140 | 70 MeV | 10 Hz | 41 J | 0.002 |
| → increase voltage | 1.8 MV | 140 | 250 MeV | 10 Hz | 161 J | 0.002 |
| Alternative 2-low amplified potential → broaden distribution, select from tail, increase frequency | 400 kV | 100 | 40 MeV | 10 Hz-1.5 kHz | 116 J | 0.4 |

Two alternative designs are shown in FIG. 10 and Table 1. The first is for the case in which high amplification factors are not used. In this case, the applied voltage is increased to compensate. This leads to an increase in power consumption and a less narrow energy distribution. The second is a design option for even lower amplification factor, and with a higher value of $A_2$ (which accounts for the fraction of the energy from the amplification effect that can be randomized during the fast event through collisions). This option shows a solution where the peak of the energy distribution is limited to 40 MeV. In this case, the pulse frequency is increased significantly and high energy particles are selected from the tail of the distribution function. In summary, design alternatives exist for different amplification factors and applied voltages that still result in a very compact system for proton therapy.

The power supply for design options of the accelerator operating with less than 500 kV utilizes commercially-available components (such as power supplies from Glassman, Inc. and commercial bushings and insulated cables from a number of suppliers) with dimensions 8'×6'×6'. The power supply does not need to be mounted on the gantry with the energy storage system.

The power supply for design options greater than 500 kV may require custom power supply components, for example a Marx generator. The components are larger than the <500 kV components, but not prohibitively large to prevent gantry mounting of the accelerator, since the power supply need not be mounted with the accelerator.

Beam Conditioning

Many applications of plasma accelerators require that the phase space of the particle beam fall within a specific set of conditions; for example a narrow range of particle energy and/or dispersion angle. For some applications, the phase space requirements may not be achievable by directly manipulating the accelerator and a device is necessary to condition the output of the accelerator to the desired phase space.

Figure 11:
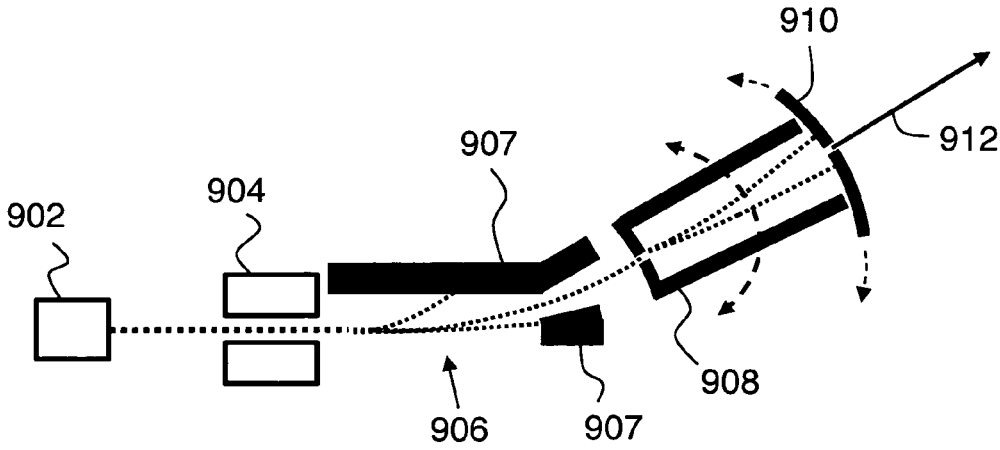
FIG. 11 shows apparatus for a particle therapy application embodiment of the invention.

One example of a beam conditioning device for selecting a specific energy distribution from a broadly distributed beam and ensuring a certain degree of beam collimation is shown in FIG. 11. This example may be used to condition the beam of the plasma accelerator to obtain the desired phase space characteristics for particle therapy. The jet from the accelerator 902 first passes through a collimator 904 that shields all protons that are not within a certain diameter of the centerline. The collimated plasma jet then enters a magnetic field region 906. The magnetic field disperses the charged particles based on their kinetic energies. A fixed collimator 907 then rejects all particles outside of the energy range that could be used for particle therapy. A rotating collimator 908 is located some distance downstream and can be moved to down-select particles of a desired energy with a precision determined by the size of the opening in the collimator. Rotation of the collimator allows for selection of output beam energy. A second, smaller magnet may be added to disperse the selected beam further and is then followed by a second rotating collimator 910 that can select protons with greater accuracy than the first rotating collimator. The resulting output beam is referenced as 912. The entire assembly may be mounted on a movable gantry so that the output beam 912 can be directed at the desired target site. Other embodiments of the beam conditioning device may involve more or fewer magnet/collimator stages, and may or may not include the initial fixed collimation and energy selection stage. Alternate designs could also use fixed collimators and a tunable magnet for energy selection. They may also include beam optics which correct or preserve the spatial profile of the accelerator output beam.

This system relies on the application of a plasma accelerator to achieve a device size that is significantly smaller than existing solutions. In addition, the broad energy spectrum of the plasma accelerator (with respect to the narrow spectrum of existing cyclotrons and synchrotrons) combined with the variable energy selection device may prove useful for simultaneously irradiating a tumor at multiple depths without the use of a degrader in the beam line.

Existing commercial solutions for proton therapy rely on large cyclotron or synchrotron accelerators. Both operate by accelerating ions with an electric field, and confining them into a circular orbit with large magnetic fields. Repulsive forces between the ions and/or the need for powerful magnets to send the high energy ions on circular paths ultimately limit the minimum achievable device size.

Adding electrons to the ions (thereby creating a plasma) shields the repulsive forces between ions, which allows for much higher ion density in a compact and linear device that does not require confinement magnets. A plasma-based accelerator concept therefore has the potential to make affordable, compact proton therapy possible. The simplicity and extreme compactness of electromagnetic plasma accelerators may provide proton beams with comparable energy to large proton facilities in a footprint similar to existing advanced x-ray therapy machines.

The use of carbon ions for particle therapy is gaining acceptance worldwide. None of the acceleration processes within the plasma deflagration device fundamentally limit its use to protons. This approach can also be tailored to operate with carbon, or any other species. Injection of the carbon into the accelerator may be achieved using a variety of methods such as operating on a hydrocarbon gas, inducing breakdown on a carbonaceous material, or injecting small carbon particles.

B2 Application to Radioisotope Production

Plasma accelerators according to the above-described principles are also applicable for radio-isotope production by interacting high-energy plasma with a suitable target material to produce radionuclides, especially positron-emitting radioisotopes for PET imaging.

A first example of this approach involves a plasma-based accelerator operating on hydrogen with 10+ MeV beam energy and 50+ μA beam current (at 1 Hz pulse frequency). The accelerator is coupled with an appropriate target in which the isotope-producing nuclear reactions take place upon impact by the particle beam. Table 2 Table 2 summarizes the operating parameters of three different designs.

TABLE 2

Operating parameters for preferred and two alternative designs.

| Design Option | Applied Voltage | Peak of Distribution | Required Frequency | Capacitance (Capacitor Volume) | Input Power |
|---|---|---|---|---|---|
| Preferred Design high amplification | 450 kV | 11.25 MeV | 1 Hz | 11 nF ($0.1\ m^3$) | 2.3 kW |
| Alternative 1- low amplification | 450 kV | 4.5 MeV | 10 Hz | 11 nF ($0.1\ m^3$) | 23 kW |
| Alternative 2- low voltage low amplification | 200 kV | 5 MeV | 10 Hz | 24 nF ($0.03\ m^3$) | 5 kW |

Only the accelerator and target of the preferred design are shielded. The compact nature of the plasma accelerator means that a much smaller volume must be shielded. The accelerator power supply is located outside of the shielded region. The preferred design may also involve automatic exchange of the target gas or liquid without user access to the shielded portion of the accelerator. Exchange can occur via plumbed systems, for example, which inject the target fluid from an external reservoir and extract the radioactive fluid to an externally-accessible shielded compartment.

Overall, the goal of the preferred design is to enable a self-shielded system that is compact and user-friendly enough that special facilities and operators are not required for the system.

The preferred design may involve a re-circulating gas or water target for the purpose of maintaining the desired temperature in the target material during bombardment from the accelerator.

A major limitation to the widespread adoption of PET is the cost, size, and shielding requirements of the accelerators used to produce PET tracers. These accelerators must be on-site or near-site to accommodate the short half-lives of the most commonly-used radioisotopes. Current commercially-available isotope production units are primarily based on cyclotron accelerators, which compared to plasma accelerators are complex, expensive, and large. By reducing all three of these factors, the plasma accelerator-based system opens the market to new customers that previously could not afford these systems in their own hospitals or imaging centers. Making isotope production units available to common hospitals and imaging centers also may enable the more widespread use of improved, shorter-lived radioisotopes since the materials will no longer be transported in from distant radioisotope production facilities.

By utilizing a plasma accelerator, the beam energy of the device is consistent with commercially-available accelerators but with a significant reduction in cost and size compared with the smallest, lowest-cost commercially available isotope production units.

This system is advantageous over current systems that rely on pure ion accelerators instead of plasma accelerators, and result in ion accelerator production units that are too large and costly to be installed in most hospitals.

The above-described designs are just a few possible implementations of this approach. For example, both beam energy and current factor into the isotope yield and target cooling requirements, and therefore different combinations of beam energy, beam currents and pulse frequencies can be appropriate depending on the application. Several specific alternatives follow.

The overall design goal is to enable a self-shielded system that is compact and user-friendly enough that special facilities and operators are not required for the system. Key features to accomplish this goal are (i) a modular design, (ii) automation, (iii) unit dose production, and (iv) high-current+low energy operation, which can be practiced individually or in any combination.

The modular design enables individual components to be removed and replaced easily, rather than being repaired. The emphasis is thus on constructing the radio-isotope production system from modules that can be handled easily and whose location on the system is quickly accessible. Rather than repairing components, an incorporated diagnostic system notifies the user of any error that occurred and simultaneously provides specific information about the module or modules from which this error originated. The user can then replace the module with a spare one. The system is designed such that the modules are easily accessible, for example by minimizing the number of modules that have to be placed inside the shielded volume and where that is not possible, by including doors or removable panels in the shielding at appropriate locations. Furthermore, the modules are designed for quick release and installation, for example using snap on connectors. Examples of components that can be made modular include, but are not limited to:

Accelerator
Mass feed system
Vacuum pump(s)
Power supply
Capacitor(s) or energy storage system
Switches
Cooling system
Sensors
Microchips
Beam target systems
Radiochemistry kits (e.g. Microfluidics chips)
Reagents
Radiochemistry Quality Control
Beam diagnostics Automation further simplifies and accelerates the use of the radio-isotope production system and reduces the potential radiation exposure of personnel. In one example, the user selects a type of radio-isotope or radio-tracer and the desired amount. This selection may also be programmed to occur at a specific time. The automated system then selects and executes the appropriate settings, such as accelerator voltage, pulse frequency, irradiation duration, and radiochemistry reagents. The chemical processing, purification and quality control of the isotope or radiotracer molecule can also be automated, for example by using actuated components on a microfluidics chip that are controlled by a microchip or the system computer. The automated sequences of events and settings can be preprogrammed based on defined rules, but can also be designed to incorporate and respond to feedback from sensors. It is preferred to complete the chemical processing of the generated isotope automatically within the shielded volume. Whether this option is chosen or not, a desirable feature is to exchange the isotope or processed radiotracer across the shield in a simple and fast manner. This is either accomplished through appropriate plumbing, controlled by electric or hydraulic/pneumatic actuators or through moving components that can insert, position and eject consumables, such as microfluidic chips, as desired.

In the Unit Dose embodiment, an electromagnetic plasma accelerator is used to produce individual unit doses of radioactive substances. The term unit dose refers to the amount needed (in units of radioactivity) to carry out a specific medical therapy or imaging procedure in a living organism, plus an amount necessary to account for decay during processing of the raw radioisotope into the useful radioactive substance and delivery to the organism.

The radioactive substances that can be produced include, but are not limited to, carbon-11, nitrogen-13, oxygen-15, and fluorine-18, or any of a large number of derivatives of these substances.

In this embodiment, the accelerator is combined with a beam target system, a radiochemistry system, and a quality control system (optional). These systems are preferably arranged in separate modules that are easily replaced by an unskilled user. Additionally, the systems communicate automatically with one another.

The electromagnetic accelerator is used to create charged particle beams with distributions of particle energies ranging from 10 keV to 30 MeV (always containing at least some particles with energy <5 MeV), depending on the reaction cross section of the substances to be collided to produce the radioisotope. The average beam current is chosen to produce a unit dose of activity in approximately 5-30 minutes based on the beam energy distribution and reaction cross section for the desired radioisotope. The average beam current can range from 1 microAmp to 500 milliAmp. The pulse frequency of the electromagnetic accelerator can range from 0.1 Hz to 10 kHz.

The beam target system can include a liquid, gas, or solid target. In the liquid form, the target may be under high pressures and circulating to and from the irradiation area to avoid vaporization.

The radiochemistry system preferably includes a microreactor system built specifically for the small volumes associated with the unit dose approach. The microreactor system is contained in a module specifically designed for the production of a certain radioactive substance, such as Fludeoxyglucose ($^{18}F$). The module can be easily replaced with modules built specifically to produce other substances.

A quality control module is optionally included in the unit dose production system. This module may contain diagnostics to determine one or more of the following about the produced radioactive substance: identity, strength, stability, quality, purity, sterility and pyrogens.

High Beam Current, Low Beam Energy Operation/Deflagration Mode without Amplification A particular way to use the advantages of a plasma deflagration gun is to take advantage of its high plasma densities and resulting high beam current to compensate for lower beam energy than traditional medical particle accelerators. This can enable sufficient radio-isotope production near the threshold energy for the isotope producing nuclear reactions where cross-sections are generally low. For example, $^{18}F$ production via the $^{18}O(p,n)^{18}F$ has a threshold of approximately 2.4 MeV, but a reaction cross section of only 3.6 millibarns at that energy. For that reason, beam energies well in excess of 7 MeV, where the cross-sections are on the order of 300 millibarns are generally used by cyclotrons. The significantly higher beam current of a plasma gun compared to that of a cyclotron can enable $^{18}F$ production at low beam energies, however, as the higher particle flux compensates for the lower reaction yield. In addition, this advantage can make lower yield reactions with lower cross-sections but much lower threshold energies feasible, such as the $^{12}C(d,n)^{13}N$ reaction to generate $^{13}N$ with a threshold energy of 330 keV and the $^{10}B(d,n)^{11}C$ reaction to generate $^{11}C$ with a threshold energy below 500 keV. The lower required beam energies can lead to significant reductions in complexity and cost of the system. The desirable parameter range for this embodiment would have an ion beam average current of 50 μA or more (for the relevant species) and the particles contributing to this average current would have a particle energy between 300 keV and 5 MeV. The possible presence of additional particles outside of this energy range is irrelevant, as long as there is 50 μA or more of ion beam average current provided by particles in this energy range. For a pulsed system, the ion beam average current is to be averaged over two or more pulses. At these low beam energies, a deflagration gun could be used without the need for additional amplification from inductive coupling. Instead an appropriately high voltage above 300 kV could be directly applied across the electrodes, either directly from a high voltage power supply or through the use of a Marx-generator.

The invention claimed is:

1. A method for producing accelerated charged particles, the method comprising:

providing a plasma discharge operating in a deflagration mode and having a gas flow that defines upstream and downstream directions; and inductively coupling energy to charged particles of the plasma discharge to provide accelerated charged particles as an output;

wherein the inductively coupling energy to charged particles is provided at least in part by formation of a current loop having an inductively amplified circulating current in or passing through part of the plasma discharge.

2. The method of claim 1, wherein an inductance of the current loop is smaller than an inductance of a current distribution prior to formation of the current loop.

3. The method of claim 1, wherein the coupling energy to charged particles is provided at least in part by application of a magnetic field.

4. The method of claim 1, wherein the plasma discharge is formed by energizing electrodes prior to providing input gas or no more than 200 μs after providing input gas.

5. A method for radio-isotope production comprising providing accelerated charged particles according to the method of claim 1; and delivering the accelerated charged particles to a target for radio-isotope production.

6. A method for producing accelerated charged particles, the method comprising:

providing a plasma discharge operating in a deflagration mode and having a gas flow that defines upstream and downstream directions; and inductively coupling energy to charged particles of the plasma discharge to provide accelerated charged particles as an output;

wherein the inductively coupling energy to charged particles is provided at least in part by collapse of a current distribution of the plasma discharge from a first configuration to a second configuration having greater self-inductance than the first configuration.

7. The method of claim 6, wherein the second configuration is localized at a downstream part of the first configuration.

8. A method for radio-isotope production comprising providing accelerated charged particles according to the method of claim 6; and delivering the accelerated charged particles to a target for radio-isotope production.

9. Apparatus for producing accelerated charged particles, the apparatus comprising:

a plasma discharge source capable of operating in a deflagration mode and having a gas flow that defines upstream and downstream directions; and an inductive coupling subsystem capable of inductively coupling energy to charged particles of the plasma discharge to provide accelerated charged particles as an output;

wherein an electrode length of the plasma discharge source is within about 20% of a length of the plasma discharge when inductive coupling of energy to charged particles of the plasma discharge occurs.

10. The apparatus of claim 9, wherein a circuit inductance of said apparatus is 500 nH or more.

11. The apparatus of claim 9, wherein the apparatus includes electrodes for the plasma discharge having inductance per unit length that decreases in the downstream direction.

12. The apparatus of claim 11, wherein an inductance per unit length at a downstream location of the plasma discharge is 50% or less of an inductance per unit length at an upstream location of the plasma discharge.

13. The apparatus of claim 9, wherein an electrical ringing frequency of the apparatus is 50 kHz or greater.

14. The apparatus of claim 9, further comprising a particle source disposed at a downstream location of the plasma discharge.

15. Apparatus for radio-isotope production including the apparatus for producing accelerated charged particles of claim 9.

16. Apparatus for producing accelerated charged particles, the apparatus comprising:

a plasma discharge source capable of operating in a deflagration mode and having a gas flow that defines upstream and downstream directions; and an inductive coupling subsystem capable of inductively coupling energy to charged particles of the plasma discharge to provide accelerated charged particles as an output;

wherein the apparatus has a circuit inductance of 50 nH or less, and includes electrodes for the plasma discharge having inductance per unit length of 450 nH/m or more.

17. Apparatus for radio-isotope production including a plasma source of accelerated charged particles capable of operating in a deflagration mode to provide a particle beam having an ion beam average current of 50 μA or more, where particles contributing to the ion beam average current have energy between 300 keV and 5 MeV.

* * * * *